US010568404B2

(12) United States Patent
Tapocik

(10) Patent No.: US 10,568,404 B2
(45) Date of Patent: Feb. 25, 2020

(54) CHILD-RESISTANT LOCKING CAP FOR LAMINATED TUBES WITH IMPROVED LOCKING CAP INSERT TO REDUCE SUBSTANCE LEAKAGE AFTER THE LOCKING CAP IS CLOSED

(71) Applicant: Bryan Tapocik, Highland, CA (US)

(72) Inventor: Bryan Tapocik, Highland, CA (US)

(73) Assignee: Innovative Product Brands, Inc., Highland, CA (US)

( * ) Notice: Subject to any disclaimer, the term of this patent is extended or adjusted under 35 U.S.C. 154(b) by 27 days.

(21) Appl. No.: 15/951,956

(22) Filed: Apr. 12, 2018

(65) Prior Publication Data

US 2018/0228269 A1 Aug. 16, 2018

Related U.S. Application Data

(63) Continuation-in-part of application No. 15/396,725, filed on Jan. 2, 2017, now Pat. No. 10,343,827.

(51) Int. Cl.

| | |
|---|---|
| ***B43M 11/06*** | (2006.01) |
| ***A45D 34/04*** | (2006.01) |
| ***B65D 50/04*** | (2006.01) |
| ***B65D 1/02*** | (2006.01) |
| ***B65D 35/10*** | (2006.01) |

(52) U.S. Cl.

CPC ..... *A45D 34/041* (2013.01); *B65D 1/023* (2013.01); *B65D 35/10* (2013.01); *B65D 50/041* (2013.01); *B65D 50/046* (2013.01); *B65D 2215/02* (2013.01); *B65D 2215/04* (2013.01); *B65D 2501/0009* (2013.01)

(58) Field of Classification Search

CPC .. B65D 35/10; B65D 50/041; B65D 2215/02; B65D 2215/04

USPC ..... 401/183

See application file for complete search history.

(56) References Cited

U.S. PATENT DOCUMENTS

| | | | | |
|---|---|---|---|---|
| 3,976,224 | A * | 8/1976 | Ericson | B65D 35/02 222/107 |
| 6,036,036 | A * | 3/2000 | Bilani | B65D 50/046 215/216 |
| 8,051,999 | B2 * | 11/2011 | Carmody | B65D 41/0471 215/216 |
| 8,647,006 | B2 * | 2/2014 | Greer, Jr. | B05C 17/002 401/183 |
| 2018/0126138 | A1 * | 5/2018 | White | B65D 50/04 |

* cited by examiner

*Primary Examiner* — Jennifer C Chiang

(74) *Attorney, Agent, or Firm* — Thomas I. Rozsa

(57) ABSTRACT

A combination of a container made out of rolled laminated plastic or rolled laminated metal, combined with a child-resistant locking assembly between the container and a cap removably affixed to the container. The container includes a closed rear end, a front wall and a flexible sidewall between the closed rear end and the front. The cap includes a central post inserted into a dispensing opening in a dispensing nozzle of the contain to reduce the possibility of contents in the container seeping out of the dispensing nozzle after the sealing cap is affixed to the nozzle.

13 Claims, 17 Drawing Sheets

CHILD-RESISTANT LOCKING CAP FOR LAMINATED TUBES WITH IMPROVED LOCKING CAP INSERT TO REDUCE SUBSTANCE LEAKAGE AFTER THE LOCKING CAP IS CLOSED

CROSS-REFERENCE TO RELATED APPLICATION

This patent application is a continuation-in-part of application Ser. No. 15/396,725 filed on Jan. 2, 2017, now pending.

BACKGROUND OF THE INVENTION

1. Field of the Invention

The field of the invention relates to the area of containers with contents that require security to prevent a child from opening the container.

2. Description of the Prior Art

The present inventor is not aware of any prior art relating to his invention.

SUMMARY OF THE INVENTION

The present invention is a combination of a container made out of rolled laminated plastic or rolled laminated metal combined with a roller ball applicator, combined with a child-resistant locking assembly between the container and a cap removably affixed to the container The container includes a closed rear end, a front wall and a flexible sidewall between the closed rear end and the front wall. The flexible sidewall is in a shape selected from the group consisting of oval-shaped, elliptical-shaped and cylindrical-shaped.

The shape of the container is optional but preferably in the shape of a tube of toothpaste closed at a rear end and having a generally oval-shaped or generally elliptical-shaped sidewall and a front end having a front wall with an opening through which an applicator partially extends. The closed rear end, sidewall, front wall and portion of the applicator surround an interior chamber in which there is retained material which could be hazardous to a child, hereafter referred to as "a precautionary material". The applicator is used to dispense the precautionary material. The applicator is preferably a roller ball. It is within the spirit and scope of the present invention to include other types of applicators.

It is also within the spirit and scope of the present invention for the container to be cylindrical in shape with a closed rear end, a cylindrical sidewall and a front end having a front wall with an opening through which an applicator partially extends. The closed rear end, sidewall, front wall and portion of the applicator surround an interior chamber in which there is retained a precautionary material. The applicator is used to dispense the precautionary material. The applicator is preferably a roller ball. It is within the spirit and scope of the present invention to include other types of applicators.

The first key feature of the present invention is that the container is made of material selected from the group consisting of rolled laminated plastic and rolled laminated aluminum each having from one (1) to eight (8) layers of rolled laminated plastic or aluminum. The plastic is selected from the group consisting of polypropylene, polyethylene or combinations including one or more of these plastics. An important feature of the present invention is for a sidewall of the container, regardless of shape, to be flexible and squeezable so that the precautionary material is forced onto (or into depending on the applicator) the applicator which dispenses the precautionary material. The precautionary material may be dispensed onto the skin, or fingernail, or toenail of a person, or onto or into a surface, cavity, or other location of an object depending on what the precautionary material is and its intended use.

The second key feature of the present invention is that the applicator and at least a portion of the front wall of the container are closed by a removable child-resistant locking cap. The locking cap includes at least one, and preferably a pair, of locking teeth. The front wall of the container has at least one mating locking member to be engaged by the at least one locking tooth, or preferably a pair of spaced apart mating locking members to be respectively engaged by a respective locking tooth. The child-resistant locking cap has a location portion as part of the locking assembly to enable a locking tooth from the locking cap to be aligned with a respective mating locking member. The location portion on the wall of the locking cap requires knowledge of being able to find the location and cause the locking cap to rotate to perform the required alignment of each locking tooth with a respective mating locking member.

The third novel, but optional feature of the present invention is for the applicator to be a roller ball.

The present invention also include a cap removably affixed to the container with a unique child-resistant locking member to prevent a child from removing the cap and gaining access to the precautionary material within the container.

It is an object of the present invention to create a container made of rolled laminated plastic or rolled laminated aluminum each having from one (1) to eight (8) layers of rolled laminated plastic or aluminum to have a flexible sidewall to facilitate dispensing of a precautionary material within an internal chamber of the container.

It is also an object of the present invention to include a child-resistant locking assembly between the container and the removable cap to reduce the ability of a child to remove the locking cap and gain access to the precautionary material inside the container.

It has additionally been discovered, according to the present invention, that the ability to effectively seal the container, regardless of whether its shape is oval, elliptical or cylindrical, is a key innovation of the present invention and depends on the contents contained within the container. If the contents is very liquid and flows with limited viscosity, the contents may flow out of the opening in the dispensing nozzle having a roller ball applicator and seep out of the container, even after the cap is affixed to the dispensing nozzle and the child-resistant locking member is in place.

It is therefore a further object of the present invention to add an improved sealing cap to mate with an improved dispensing nozzle to securely seal the container and prevent the contents from flowing out after the container is closed. The improvement includes a central post which extends from the interior top surface of the sealing cap and is aligned with and parallel to the sidewall of the sealing cap. The dispensing nozzle is fitted with a cylindrical sponge at its dispensing end. The sponge has a central longitudinal shaft aligned with the opening of the dispensing nozzle. Therefore, the sealing cap having internal threads is fitted over the sponge and threaded onto the dispensing nozzle having mating exterior threads. An innovation of a central post is press fit through the central shaft of the sponge and the opening in the dispensing nozzle to provide a secure seal to prevent the contents of the container from seeping out, even after the container is closed. If there is no sponge, the central post is inserted directly into front opening of the nozzle opening.

In one of the embodiments, an applicator has a cylindrical shaped body made of foam or other similar absorption capable material that extends away from the central nozzle. The cylindrical shaped body also includes a centrally located open cylindrical chamber that receives a post located in the cap as just described. This embodiment of the applicator assists in retaining the contents in a useable position and as not to seep out of the container.

Further novel features and other objects of the present invention will become apparent from the following detailed description and discussion.

BRIEF DESCRIPTION OF THE DRAWINGS

Referring particularly to the drawings for the purpose of illustration only and not limitation, there is illustrated.

DETAILED DESCRIPTION OF EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention.

Figure 1:
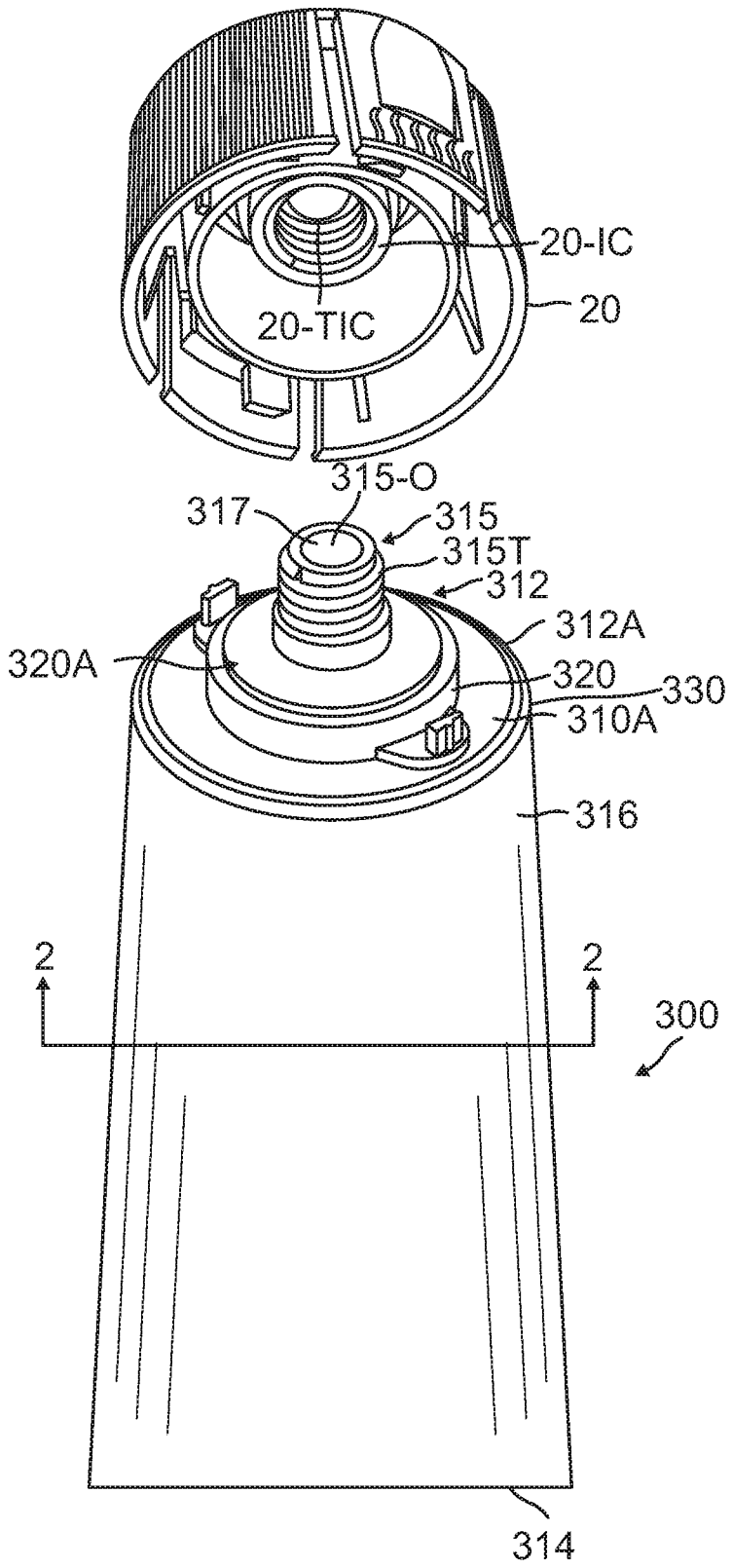
FIG. 1 is an exploded view of the present invention cap and a side perspective view of an oval-shaped container embodying a portion of the present invention.

Referring to FIG. 1, there is illustrated an exploded view of the cap 20 of the present invention viewed in a bottom perspective view and an oval-shaped container 300 illustrated in a side perspective view.

Further referring to FIG. 1, there is illustrated a perspective view of an oval-shaped container 300 in which precautionary material, such as medicines, poison, and flammable material are contained. It is within the spirit and scope of the present invention to include any items which may be hazardous or harmful to a child or any person if not handled properly. Harmless items may also be retained in the present invention.

Further referring to FIG. 1, oval shaped container 300 has a closed rear end 314, an oval-shaped sidewall 316, a front end 312 with a front top wall 312A surrounding a front wall 310A. A supporting collar 320 including a collar top wall 320A supporting a central top nozzle 315 having threads 315T on its exterior surface, the nozzle 315 including a top opening 315-O with at least a portion of a central rollerball applicator 317 extending through the opening 315-O. The cap 20 will be described in detail later on in this patent application. As illustrated in FIG. 1, the cap 20 includes an interior central collar 20-IC with mating interior threads 20-TIC which mate with threads 315T as the cap 20 is threaded onto the nozzle 315.

Figure 2:
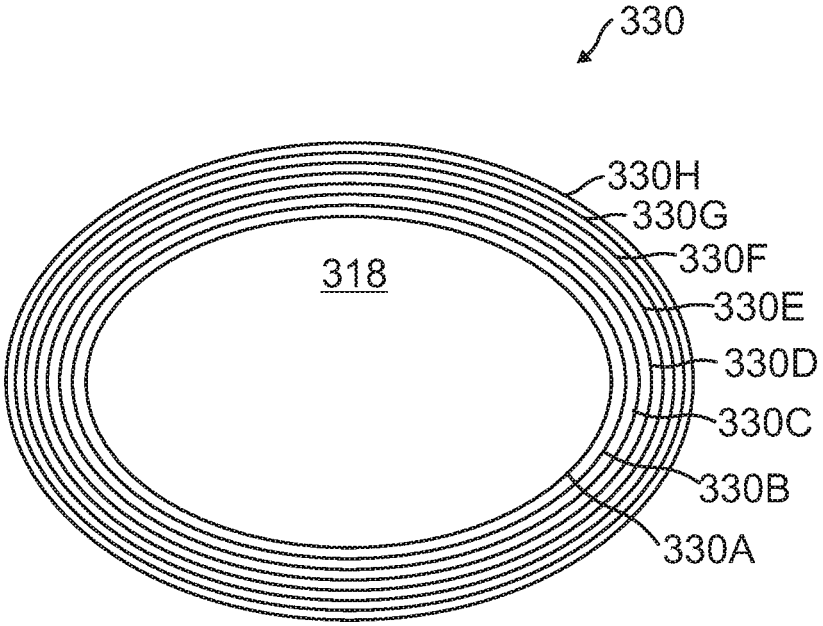
FIG. 2 is a cross-sectional view taken along line 2-2 of FIG. 1.

Referring to FIG. 2, there is illustrated a cross-sectional view taken along line 2-2 of FIG. 1, illustrating the material layers of the oval shaped container 300. The oval-shaped container 300 is made of material selected from the group consisting of rolled laminated plastic and rolled laminated aluminum illustrated in FIG. 1 as 330. The rolled laminated plastic and/or rolled laminated aluminum is preferably formed in layers having from one (1) to eight (8) layers numbered in FIG. 2 from most interior to most exterior 330A, 330B, 330C, 330D, 330E, 330F, 330G and 300H. The plastic is selected from the group consisting of polypropylene, polyethylene, polyvinyl or combinations including one or more of these plastics. This rolled laminated material creates a flexible sidewall so that the contents 8 can be squeezed out of the interior chamber to be dispensed.

Figure 3:
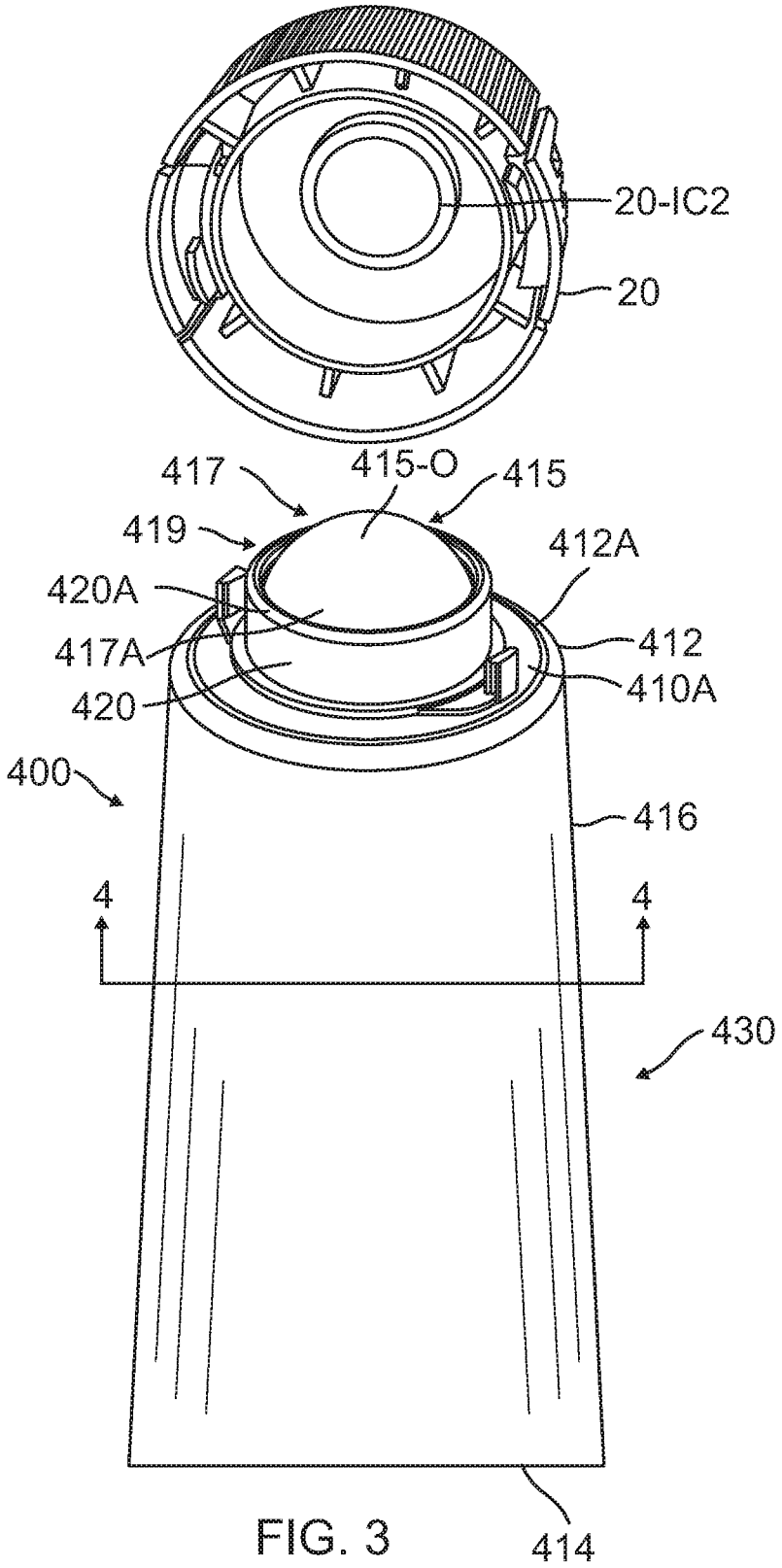
FIG. 3 is an exploded view of the present invention cap and a side perspective view of an elliptical-shaped container embodying a portion of the present invention.
Figure 4:
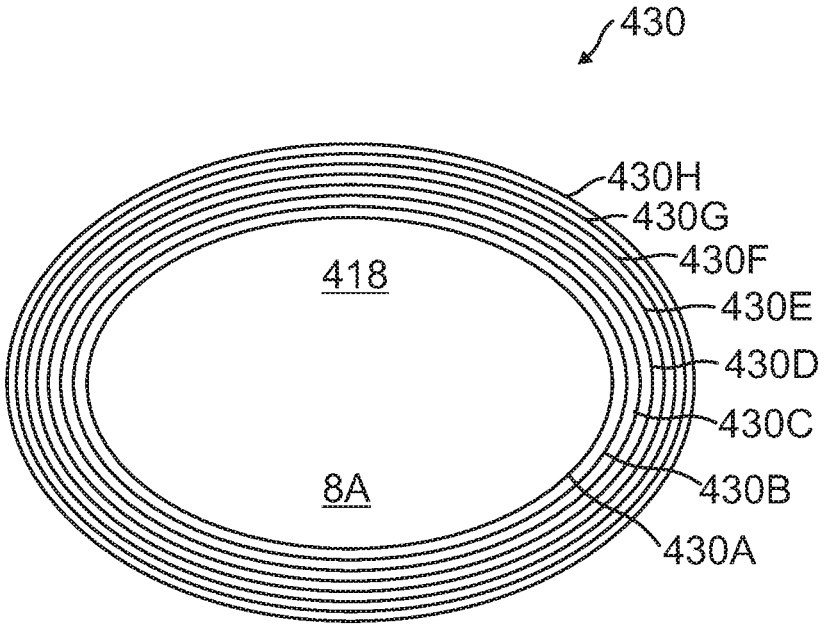
FIG. 4 is a cross-sectional view taken along line 4-4 of FIG. 3.

FIGS. 3 and 4 illustrate an alternative embodiment of the present invention having an elliptical-shaped sidewall. Referring to FIG. 3, there is illustrated an exploded view of the cap 20 of the present invention viewed in a bottom perspective view and an elliptical-shaped container 400 illustrated in a side perspective view.

Further referring to FIG. 3, there is illustrated a perspective view of an elliptical-shaped container 400 in which precautionary material 8, such as medicines, poison, and flammable material are contained within interior chamber 318. It is within the spirit and scope of the present invention to include any items which may be hazardous or harmful to a child or any person if not handled properly. Harmless may also be retained.

The elliptical-shaped container 400 has a closed rear end 414, an elliptical-shaped sidewall 416, a front end 412 with a front top wall 412A surrounding a front wall 410A. A supporting collar 420 with a top wall 420A supporting a central top nozzle 415 with a smooth surface its exterior surface the nozzle 415 including a top opening 415-O with at least a portion of a central roller ball applicator 417 extending through the opening 415-O. As illustrated in FIG. 3, the cap 20 includes an interior central collar 20-IC2 with a smooth interior to press fit retain the collar 20 against smooth surface of the central nozzle 415. The roller ball applicator numbered 417A illustrated the roller ball 417 [partially extends away from the centralized nozzle and is in contact with the contents 8A in interior chamber 418. It is also within the spirit and scope of the present invention for the roller ball applicator 417 to extend directly out of opening 417 without the nozzle. The roller ball applicator then partially extends out of front wall 412A and is partially in contact with chamber 418 so that it comes in contact with the retained precautionary material 8A to dispense the precautionary material.

The elliptical wall 416 is flexible and squeezable to dispense interior contents to the roller ball applicator. The rear end 414, elliptical-shaped sidewall 416 and front wall 412 surround an interior chamber 418 (see FIG. 4) to retain at least one of the precautionary materials 8A.

Referring to FIG. 4, there is illustrated a cross-sectional view taken along line 4-4 of FIG. 3, illustrating the material layers of the elliptical-shaped container 400. The elliptical-shaped container 400 is made of material selected from the group consisting of rolled laminated plastic and rolled laminated aluminum illustrated in FIG. 3 as 430. The rolled laminated plastic and/or rolling laminated aluminum is preferably formed in layers having from one (1) to eight (8) layers numbered in FIG. 4 from most interior to most exterior 430A, 430B, 430C, 430D, 430E, 430F, 430G and 400H. The plastic is selected from the group consisting of polypropylene, polyethylene, polyvinyl or combinations including one or more of these plastics. This rolled laminated material creates a flexible sidewall so that the contents 8 can be squeezed out of the interior chamber to be dispensed.

Figure 5:
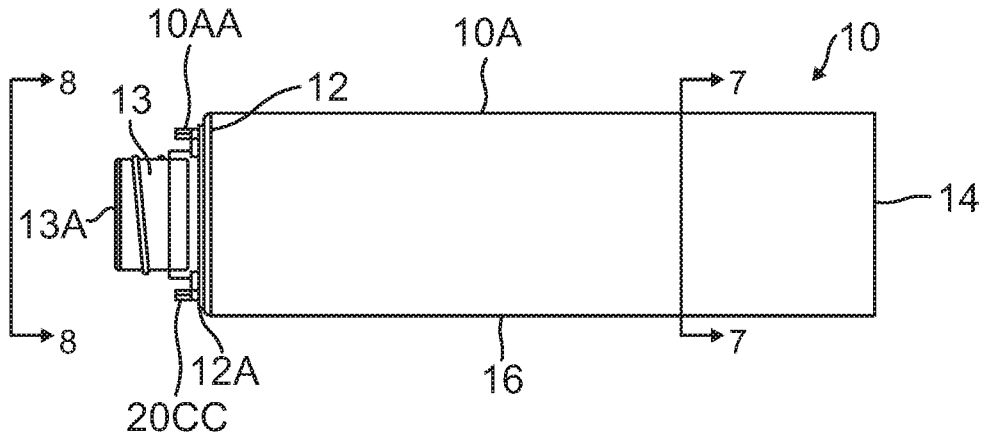
FIG. 5 is a side elevational view of a cylindrical-shaped container embodying a portion of the present invention.
Figure 6:
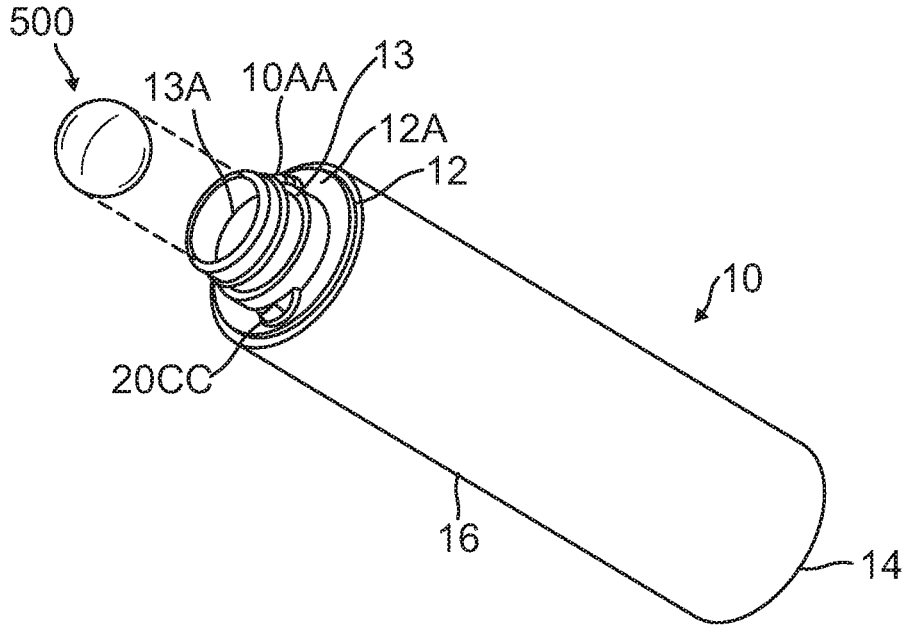
FIG. 6 is a side perspective view of a cylindrical-shaped container embodying a portion of the present invention.
Figure 7:
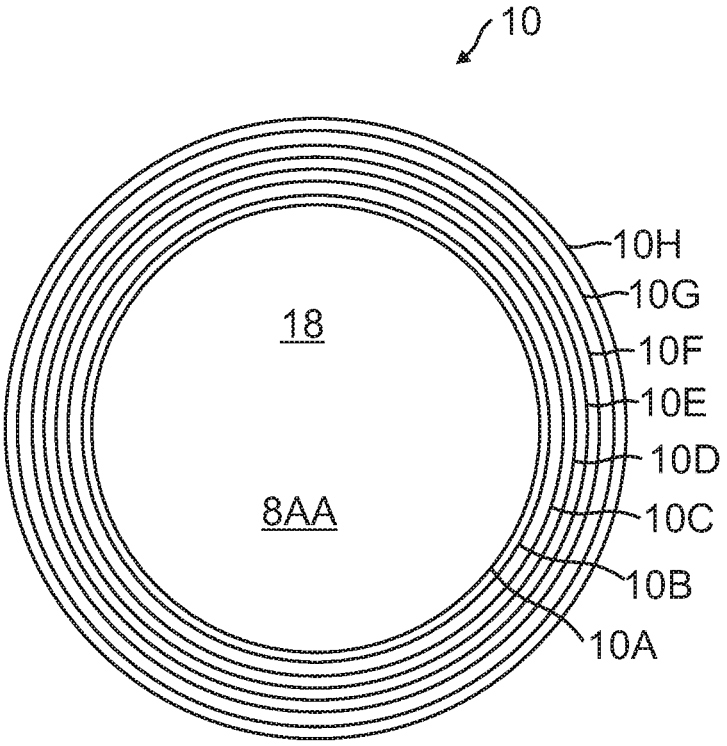
FIG. 7 is a cross-sectional view taken along line 7-7 of FIG. 5.
Figure 8:
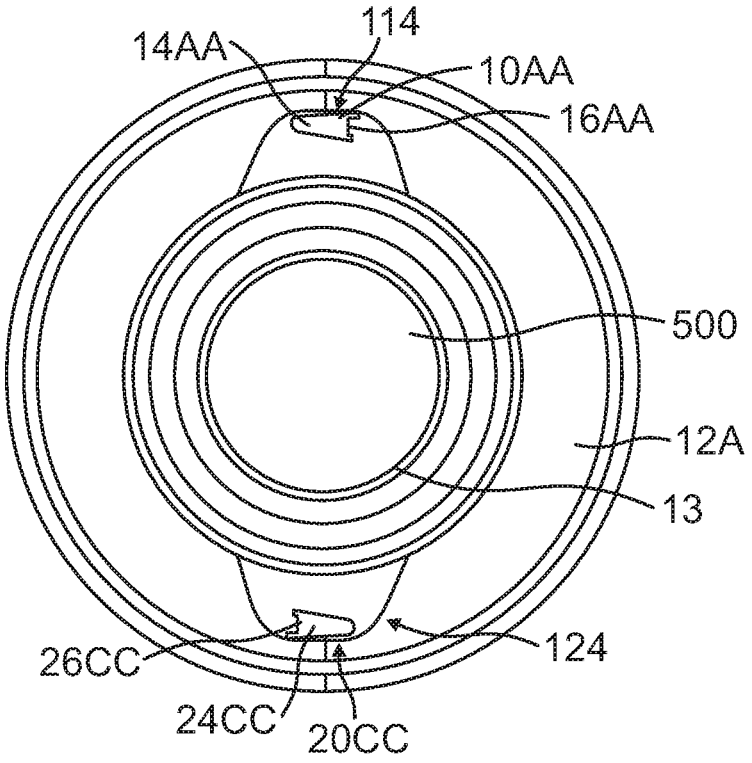
FIG. 8 is a front view taken from lines 8-8 of FIG. 5 to illustrate the mating locking members, also called tube standoff, affixed to the front wall of a container, including containers having an oval-shaped sidewall, an elliptical-shaped sidewall, and a cylindrical-shaped sidewall.

A third cylindrical variation of the container is illustrated in FIGS. 5 through 8. FIG. 5 is a side elevational view of a cylindrical-shaped container embodying a portion of the present invention. FIG. 6 is a side perspective view of a cylindrical-shaped container embodying a portion of the present invention. FIG. 7 is a cross-sectional view taken along line 7-7 of FIG. 5. FIG. 8 is a front view taken from lines 8-8 of FIG. 5 to illustrate the mating locking members, also called tube standoff, affixed to the front wall of a container, including containers having an oval-shaped sidewall, an elliptical-shaped sidewall, and a cylindrical-shaped sidewall.

FIGS. 5 through 8 illustrate an alternative embodiment of the present invention having a cylindrical-shaped sidewall.

Further referring to FIG. 5 through 7, there is illustrated a cylindrical-shaped container 10 in which precautionary material 8AA, such as medicines, poison, and flammable material are contained. It is within the spirit and scope of the present invention to include any items which may be hazardous or harmful to a child or any person if not handled properly. Harmless items may also be retained.

The cylindrical-shaped container 10 has a closed rear end 14, a cylindrical-shaped sidewall 16, a front end 12 with a front wall 12A and a nozzle 13 and a central opening 13A through which roller ball applicator 500 partially extends away from front wall 12A and is in contact with the contents 8AA in interior chamber 18. Therefore, it is also within the spirit and scope of the present invention for the roller ball applicator 500 to extend directly out of opening 13. The roller ball applicator 500 then partially extends out of front opening 13A and is partially in contact with chamber 18 so that it comes in contact with the retained precautionary material 8AA to dispense the precautionary material.

The cylindrical sidewall 16 is flexible and squeezable to dispense interior contents to the roller ball applicator. The rear end 14, cylindrical-shaped sidewall 16 and front wall 12A surround an interior chamber 18 (see FIG. 7) to retain at least one of the precautionary materials 8AA.

Referring to the cross-sectional view of FIG. 7, the cylindrical-shaped container 10 is made of material selected from the group consisting of rolled laminated plastic and rolled laminated aluminum 10, each having from one (1) to eight (8) layers 10A, 10B, 10C, 10D, 10E, 10F, 10G and 10H of rolled laminated plastic or aluminum. The plastic is selected from the group consisting of polypropylene, polyethylene, polyvinyl or combinations including one or more of these plastics. This rolled laminated material creates a flexible sidewall so that the contents 8AA can be squeezed out of the interior chamber to be dispensed.

An important innovation of the present invention is a child-resistant locking assembly generally referred to as 100 in the subsequent figures. While illustrated using the cylindrical-shaped sidewall, the same locking assembly is also utilized with other shaped container having the above described oval-shaped sidewall 316 and elliptical-shaped sidewall 416.

Figure 9:
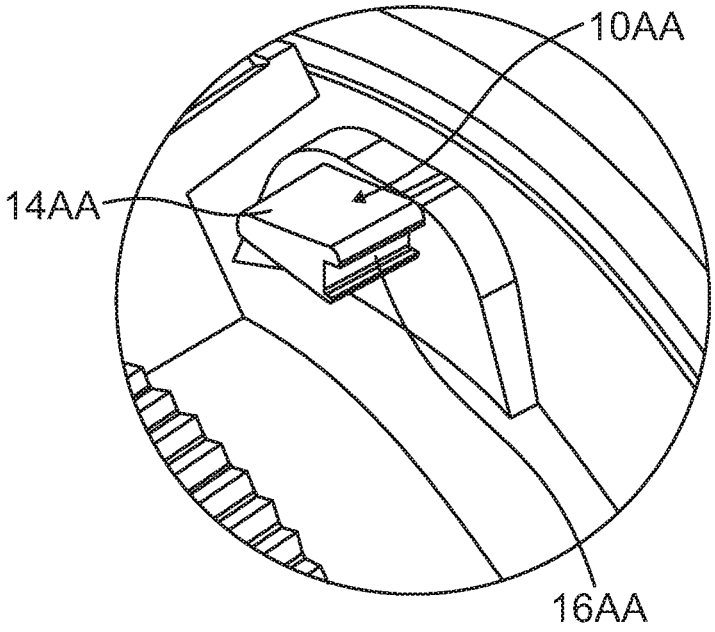
FIG. 9 is an enlarged view of a tube standoff.
Figure 10:
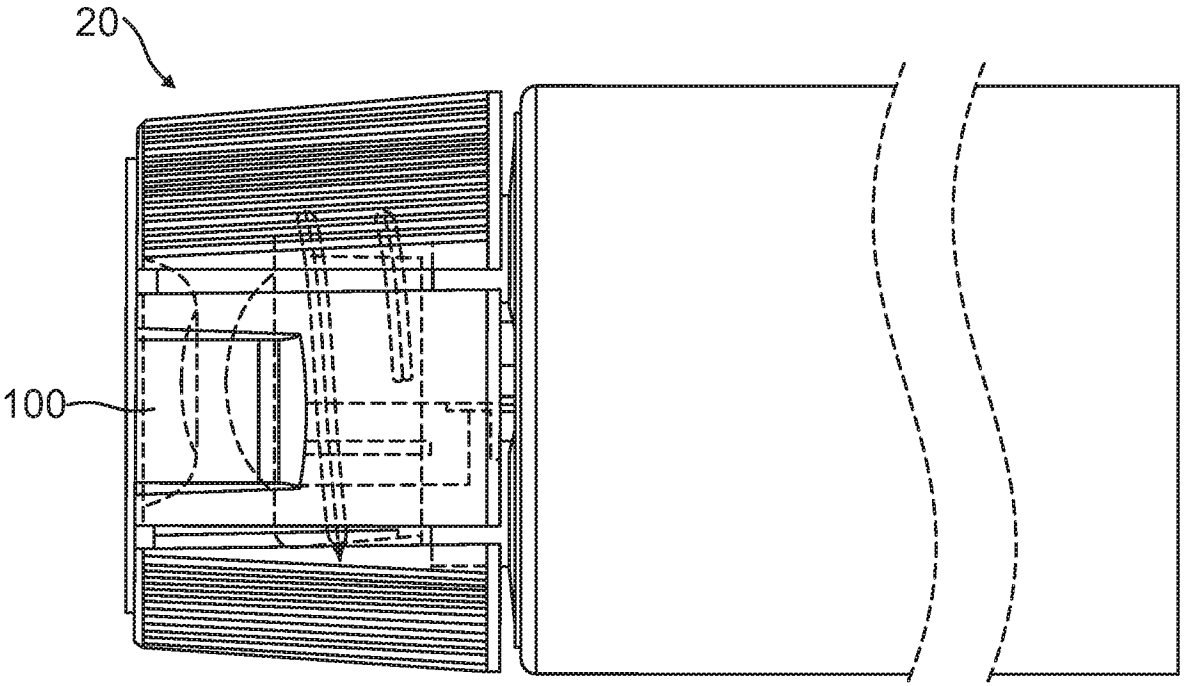
FIG. 10 is a side view of the cap illustrated in partial cross-section to illustrate a portion of the locking cavity within the cap.

FIG. 9 is an enlarged view of a tube standoff. FIG. 10 is a side view of the cap illustrated in partial cross-section to illustrate a portion of the locking cavity within the cap.

Figure 11:
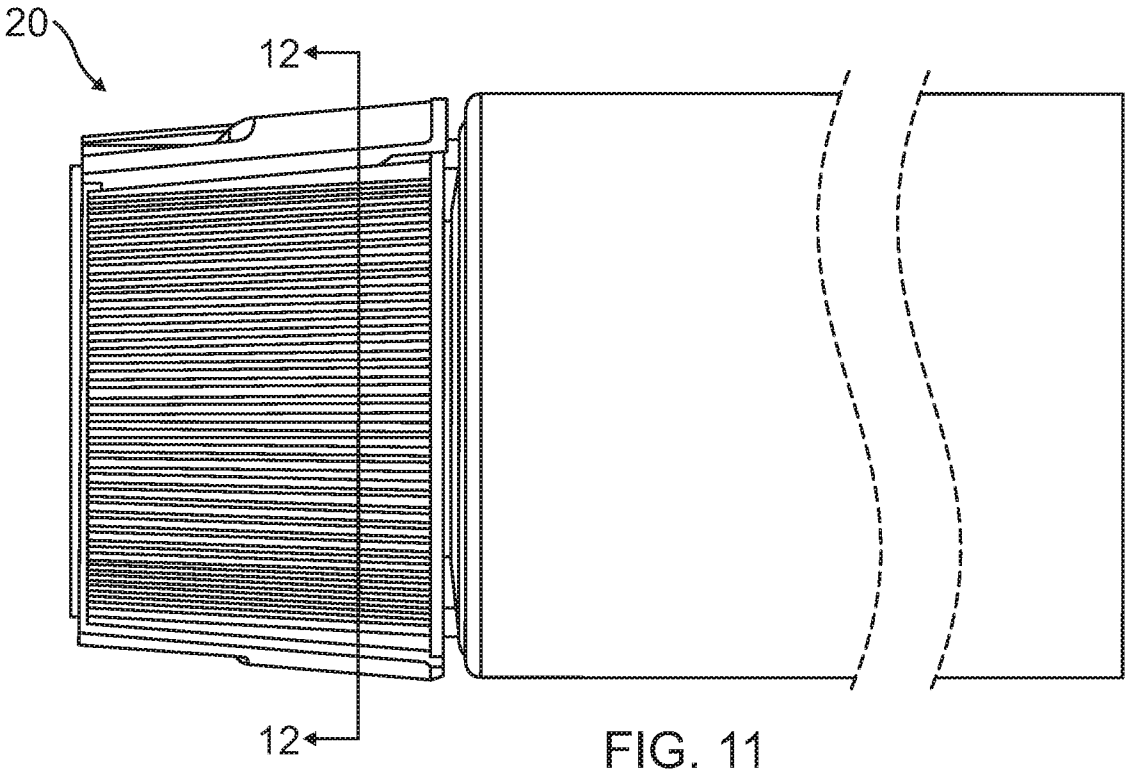
FIG. 11 is an exterior side view of the cap of the present invention.
Figure 12:
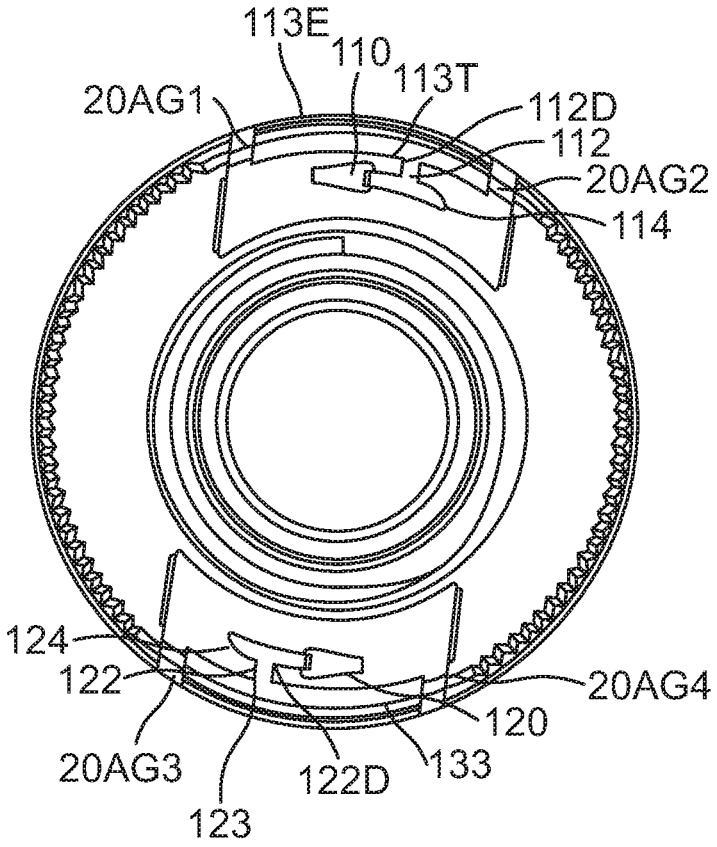
FIG. 12 is a cross-sectional view taken along line 12-12 of FIG. 11.
Figure 13:
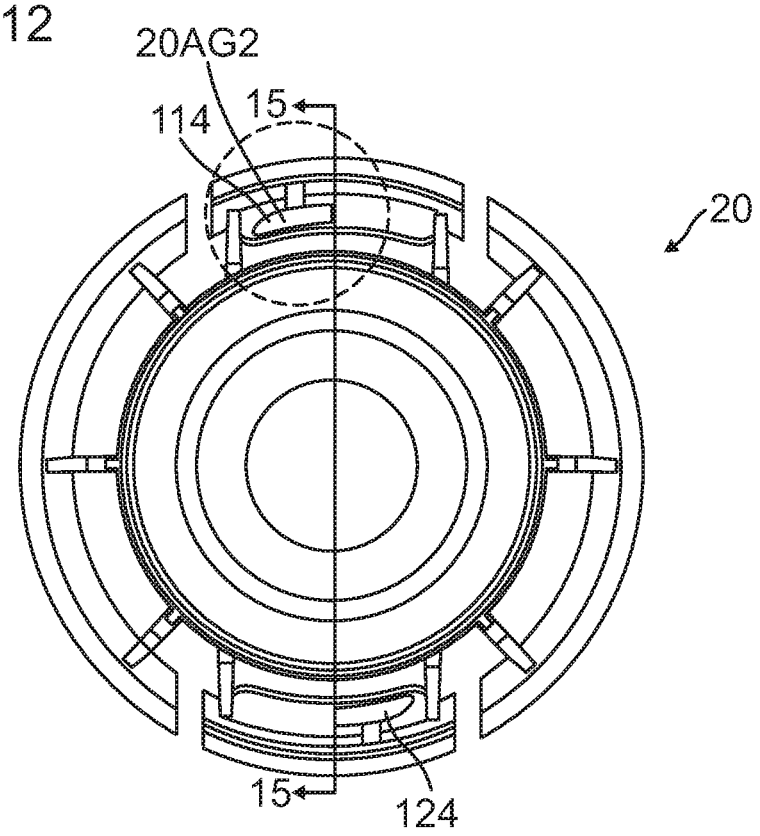
FIG. 13 is a cross-sectional of the cap illustrating a pair of oppositely disposed cap locking teeth.
Figure 14:
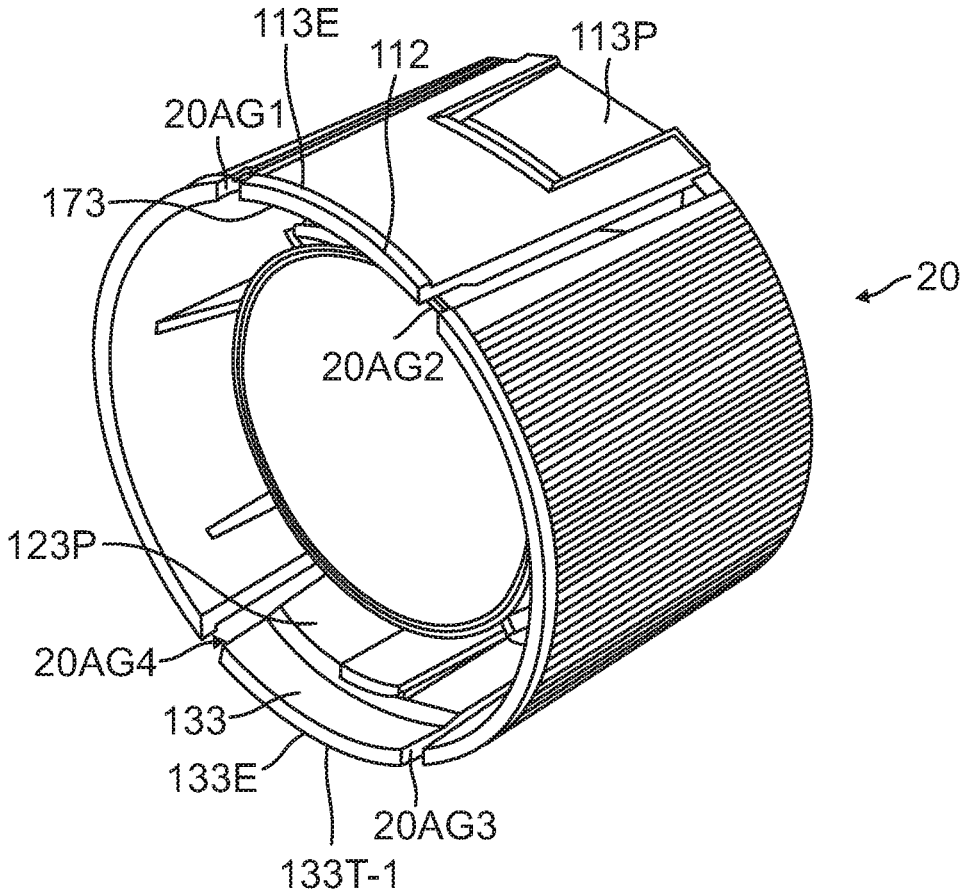
FIG. 14 is a bottom plan view of the locking assembly on the cap.
Figure 15:
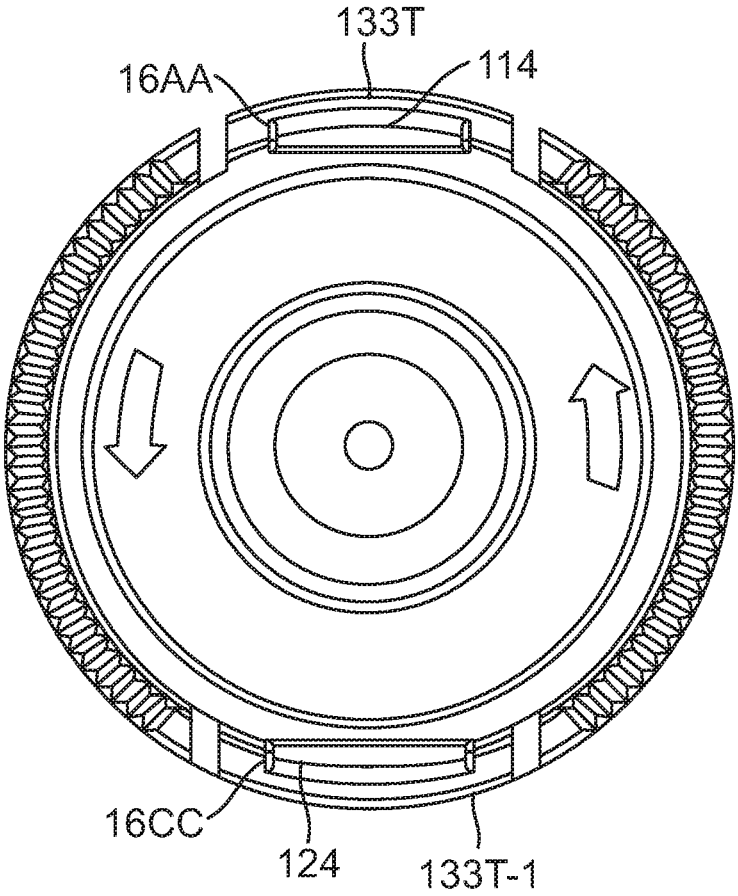
FIG. 15 is a bottom cross-sectional view of the cap in the locked position.

FIG. 11 is an exterior side view of the cap of the present invention. FIG. 12 is a cross-sectional view taken along line 12-12 of FIG. 11. FIG. 13 is a cross-sectional view of the cap illustrating a pair of oppositely disposed cap locking teeth. FIG. 14 is a bottom plan view of the locking assembly on the cap. FIG. 15 is a bottom cross-sectional view of the cap in the locked position.

FIG. 5 is a side elevational view of the container 10 with the cap removed and illustrating a pair of oppositely disposed tube standoffs 10AA and 20CC. FIG. 8 is a front view taken from lines 8-8 of FIG. 5, illustrating tube standoff 10AA having a body 14AA and a cavity 16AA. Similarly, oppositely disposed tube standoff 20CC has a body 24CC with a cavity 26CC.

FIG. 10 is a side view of the cap 20 illustrated in partial cross-section to illustrate a portion of the locking assembly 100 which has a portion of container stand-off 10AA, body 14AA and cavity 16AA, all within the cap 20. FIG. 11 is an exterior side view of the cap 20 of the present invention. FIG. 12 is a cross-sectional view taken along line 12-12 of FIG. 11. The cap 20 has a first locking member 110 having a transverse bar 112 extending from an interior wall section 113 toward the interior of the cap 20 and locking tooth 114 at the distal end 112D. A pair of gaps 20AG1 and 20AG2 are on either end of interior wall section 113. Similarly, cap 20 has a second locking member 120 having a transverse bar 122 extending from an interior wall section 123 extending toward the interior of cap 20 and a locking tooth 124 at the distal end 122D. The pair of gaps 20AG3 and 20AG4 are on either end of interior wall section 123. Gaps 20AG1 and 20AG2 enable the cap 20 to be rotated. Similarly, gaps 20AG3 and 20AG4 enable the cap 20 to be rotated.

FIG. 13 is a cross-sectional view illustrating a pair of oppositely disposed cap locking teeth 114 and 124. FIG. 14 is a bottom plan view of the locking assembly on the cap. FIG. 15 is a bottom cross-sectional view of the cap in the locked position.

Referring to FIGS. 12 through 15, in order to lock the cap 20, the cap 20 is pressed inwardly at the location 113E of interior wall 113 where locking tooth 114 is located just in front of the cavity 16AA of tube standoff 10AA and is concurrently pressed inwardly at the exterior wall location 133T-1 corresponding to the location 133E of interior wall 133 where locking tooth 124 is located just in front of cavity 16CC of tube standoff 10CC. Therefore, the tooth 114 is aligned with cavity 26CC of tube standoff 20CC and the tooth 124 is aligned with cavity 26CC of tube standoff 20CC. By rotating the cap 20 in one direction such as counter-clockwise, the respective teeth 114 and 124 engage a respective cavity 16AA and 26CC to lock the cap 20 onto the cylinder 10.

To unlock, the cap 20 must be pressed inwardly at the exterior wall location 113E corresponding to the location of interior wall 113 where locking tooth 114 is located inside of the cavity 16AA of the tube standoff 10AA and is concurrently pressed inwardly at the exterior wall location 133T corresponding to the location 133T-1 of interior wall 133 where locking tooth 124 is inside of the cavity 26CC of tube standoff 20CC and the cap 20 is rotated in an opposite direction to disengage tooth 114 from cavity 16AA and disengage tooth 124 from cavity 26CC and then cap 20 off of cylinder 10.

The present invention cap is used with all variations of sidewalls including oval, elliptical and cylindrical.

The cap 20 has an extra indentation member 113P and an oppositely disposed indentation member 123P. The indentation markers 113P and 123P serve as a guide as to where to inwardly press the cap 20 and rotate the cap into the locked or unlocked position.

As set forth in the summary of the invention section, it has additionally been discovered, according to the present invention, that the ability to effectively seal the container, regardless of whether its shape of the container is oval as illustrated in FIGS. 1 and 2, elliptical as illustrated in FIGS. 3 and 4, or cylindrical as illustrated in FIGS. 5-8, depends on the contents contained within the container. If the contents is thin and flows with limited viscosity, the contents may flow out of the opening in the dispensing nozzle and seep out of the container, even after the cap is affixed to the dispensing nozzle and the child-resistant locking member is in place.

It is therefore a further object of the present invention to add an improved sealing cap to mate with an improved dispensing nozzle to securely seal the container and prevent the contents from flowing out after the container is closed.

Figure 16:
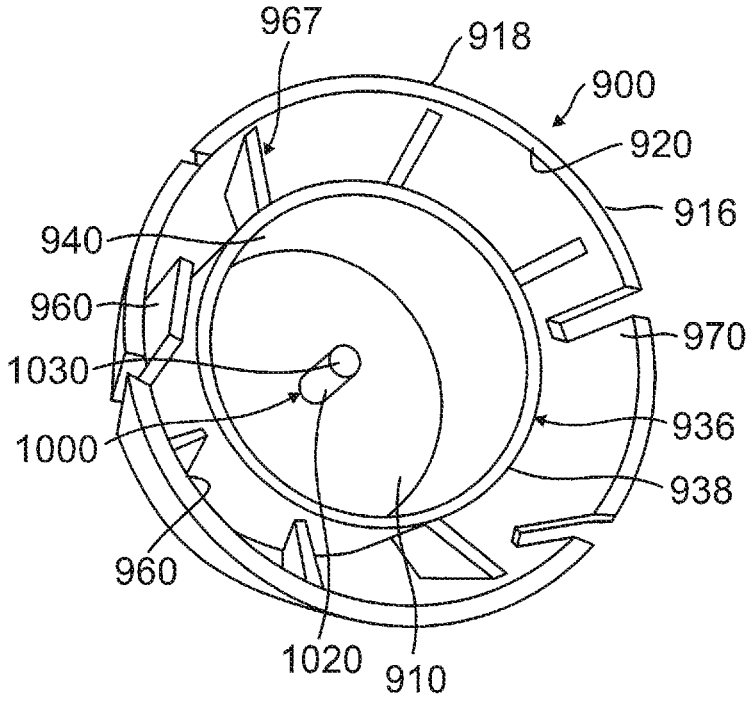
FIG. 16 is a bottom perspective view of an improved sealing cap.
Figure 17:
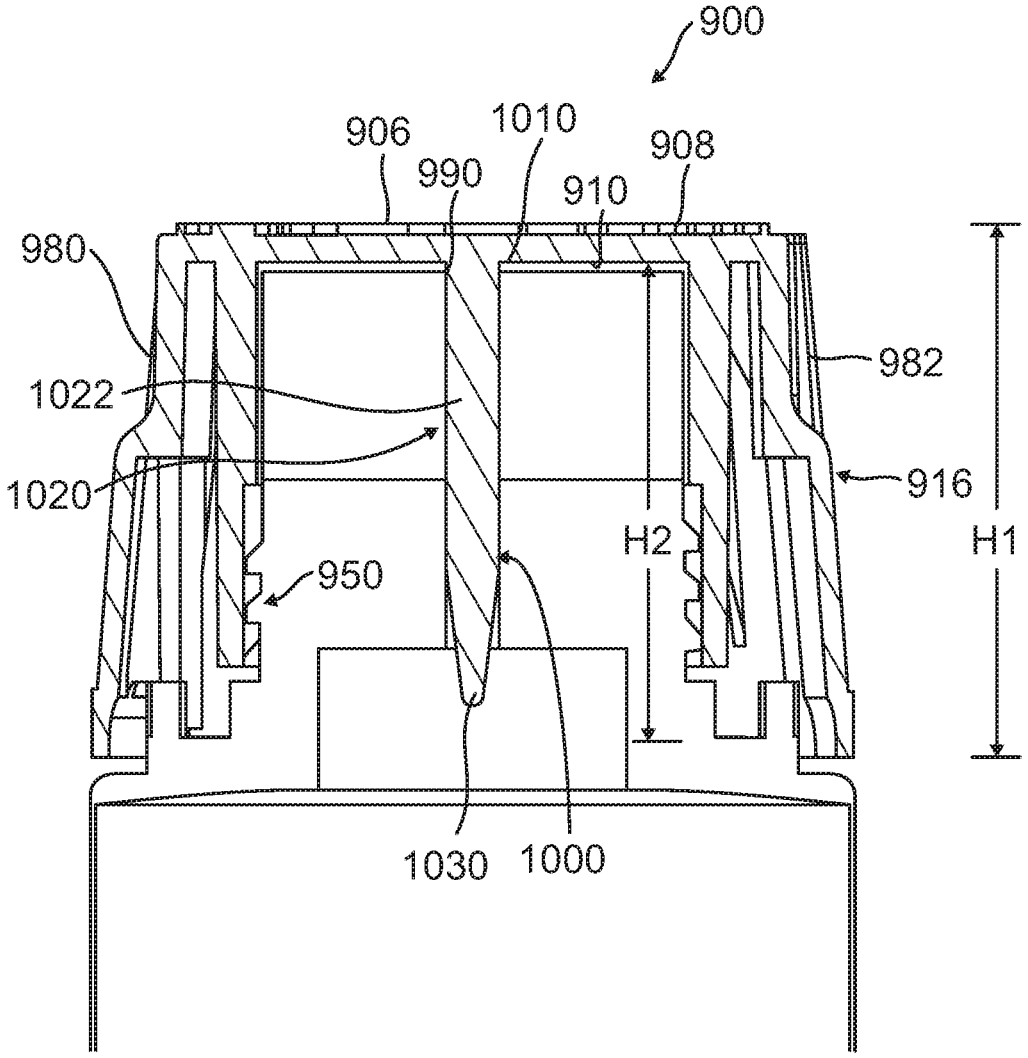
FIG. 17 is a cross-sectional view through the longitudinal center of the improved sealing cap illustrated in FIG. 16.
Figure 18:
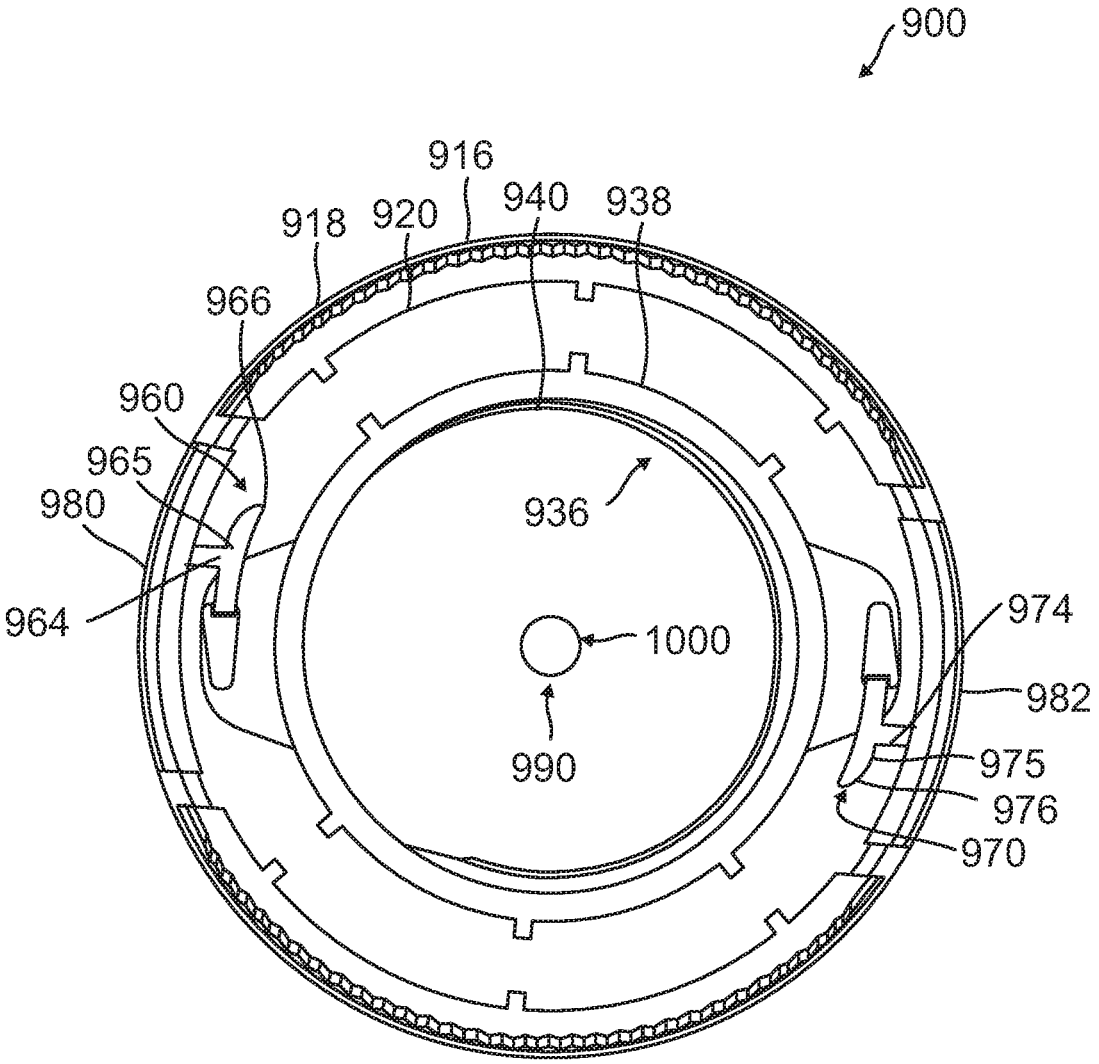
FIG. 18 is a bottom plan view of the improved sealing cap illustrated in FIG. 16.

Referring to FIG. 16, there is illustrated is a partial bottom perspective view of an improved sealing cap. Referring to FIG. 17, there is illustrated a cross-sectional view through the longitudinal center of the improved sealing cap illustrated in FIG. 16. Referring to FIG. 18, there is illustrated a bottom plan view of the improved sealing cap illustrated in FIG. 16.

Referring to FIGS. 16, 17 and 18, the improved sealing cap 900 includes a transverse top wall 906 having an exterior surface 908 and an interior surface 910. The transverse top wall 906 is integrally formed with an exterior circumferential sidewall 916 having an exterior surface 918 and an interior surface 920. The interior surface 910 of transverse top wall 906 is also integrally formed with an interior circumferential sidewall 936 having an exterior surface 938 and an interior surface 940. The exterior circumferential wall has a height "H-1". The interior circumferential wall has a second height "H-2". Height "H-1" is taller than height "H-2".

Interior circumferential sidewall 936 includes cap mating teeth 950 on the interior surface 940. Spacer members 967 are located between the interior surface 920 of exterior circumferential sidewall 916 and the exterior surface 938 of interior circumferential sidewall 936.

The interior surface 920 of exterior circumferential sidewall 916 includes a first locking member 960 including a first transverse bar 964 extending from a first interior wall—also referred to as interior surface 920 of exterior sidewall 916 toward the center 990 of sealing cap 900 and a first locking tooth 966 at a distal end 965 of the first transverse bar 964. The interior surface 920 of exterior circumferential sidewall 916 includes a second locking member 970 including a second transverse bar 974 extending from a first interior wall, also referred to as interior surface 920, of exterior sidewall 916 toward the center 990 of sealing cap 900 and a second locking tooth 976 at a distal end 975 of the second transverse bar 974. The first locking member 960 is parallel to and opposite to the second locking member 970. Up to this point, the sealing cap 900 is substantially similar to the sealing cap 20 in FIGS. 1 and 3.

A portion of the improvement is the addition of a central longitudinal post 1000 having a proximal end 1010 integrally formed at a center 990 of interior surface 910 of top transverse wall 906. The post 1000 includes an elongated shaft 1020 terminating at a distal end 1030. The body 1022 of the shaft 1020 is cylindrical except the portion of the shaft 1020 at a distance from the distal end 1030 tapers from cylindrical to a rounded pointed distal end 1030. A first marker 980 on the exterior surface 918 of the exterior circumferential sidewall 916 is aligned with the first locking member 960 and a second market 982 on an oppositely disposed location of the exterior surface 918 of the exterior circumferential sidewall 916 is aligned with the second locking member 970.

Figure 19:
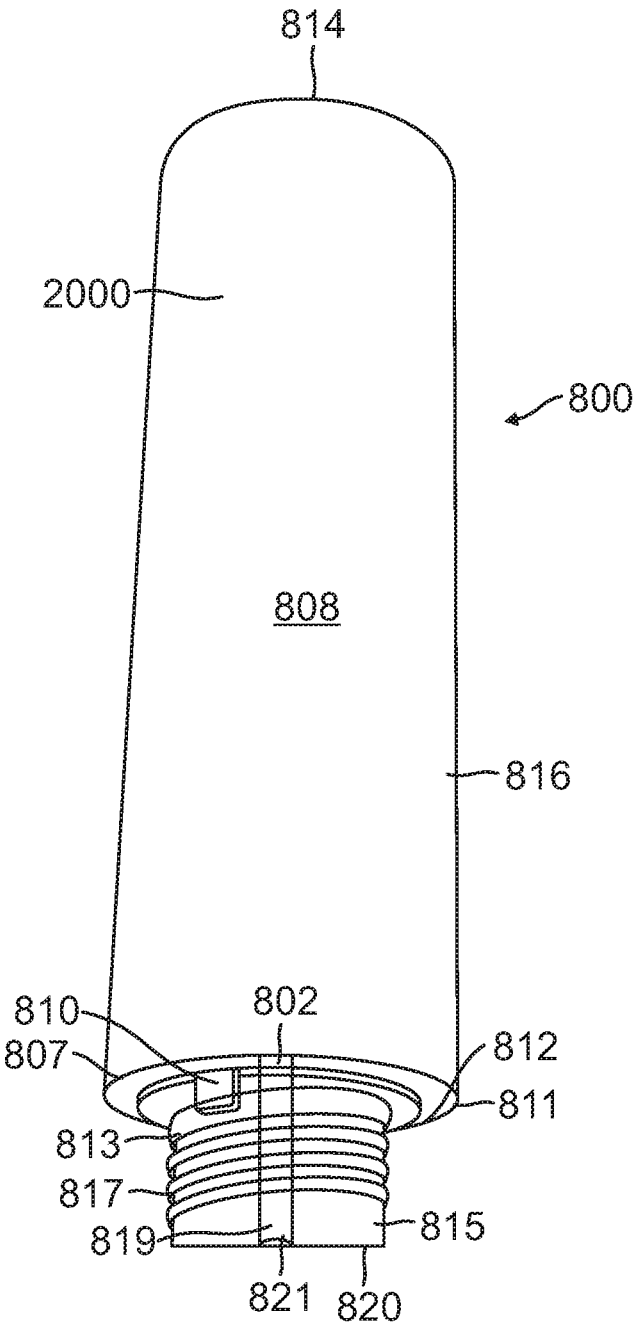
FIG. 19 is a bottom side-elevational view of an embodiment of the container with a modified dispensing nozzle used with the modified sealing cap illustrated in FIGS. 16 through 18.
Figure 20:
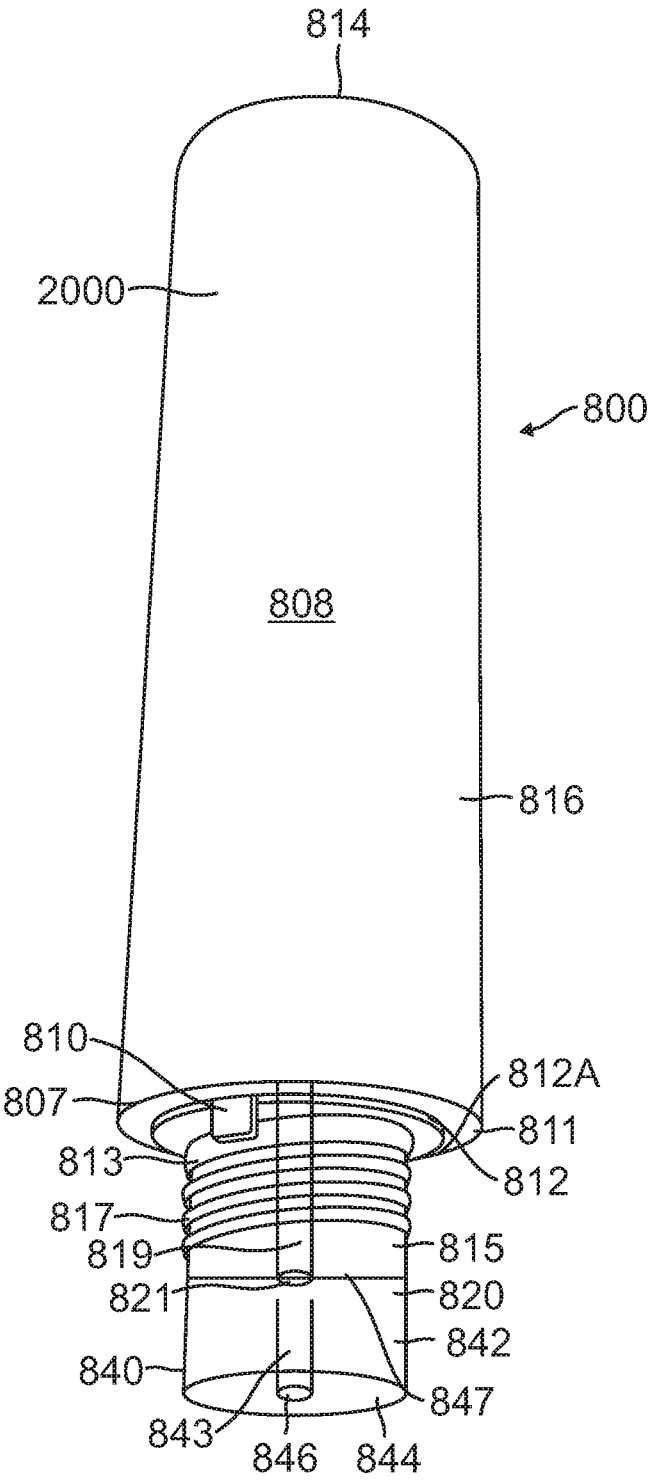
FIG. 20 is a bottom perspective view of an embodiment of the container with a modified dispensing nozzle and sponge applicator used with the modified sealing cap illustrated in FIGS. 16 through 18.

Referring to FIG. 19, there is illustrated a bottom side-elevational view of an embodiment of the container with a modified dispensing nozzle used with the modified sealing cap illustrated in FIG. 16 through 18. Referring to FIG. 20, there is illustrated a bottom perspective view of an embodiment of the container with a modified dispensing nozzle and sponge applicator used with the modified sealing cap illustrated in FIGS. 16 through 18.

In one embodiment, the container 800 includes an integrally formed exterior flexible longitudinal sidewall 816, a closed rear end 814, and a transverse front wall 812A having a centrally located dispensing nozzle 815 including a longitudinal interior shaft 819 extending from an opening 821 at a distal transverse wall 820 of the dispensing nozzle 815 and through the transverse top wall 812 to an interior chamber 808 surrounded by the closed rear end 814, the exterior flexible longitudinal sidewall 816, and the transverse front wall 812A.

The dispensing nozzle 815 includes a longitudinal sidewall 813 having mating threads 817 which mate with the threads 950 on the sealing cap 900.

In a variation or alternative embodiment of the container 900A illustrated in FIG. 20, all of the elements which correspond to the embodiment in FIG. 19 are numbered the same with an "A" after each number. The additional component is a sponge 840 or sponge applicator having a transverse proximal rear surface 847, a cylindrical body 842, and a transverse distal front surface 844. The transverse proximal rear surface 847 of the sponge 840 is affixed to the transverse front wall 820 of the dispensing nozzle 815. The sponge 840 includes an interior shaft 843 extending from the distal front surface 844 to the proximal rear surface 847 and aligned with the longitudinal interior shaft 819 of the dispensing nozzle 815. The transverse front wall 812A of the container 800 further including a first standoff 810 affixed to the front wall of the container and located between the dispensing nozzle 815 and a top circumferential edge 807 of the front wall 812A. The first standoff 810 having a first body with a first cavity extending from a surface of the first body into the first body, an oppositely disposed second standoff 811 affixed to the front wall of the container and located between the dispensing nozzle and a top circumferential edge of the front wall as illustrated in FIG. 9, the second standing having a second body with a second cavity extending from a surface of the second body into the second body, the first standoff and the second standoff parallel to each other and located on opposite sides of the dispensing nozzle.

The sealing cap 900 is removably affixed to the dispensing nozzle with the central post 1000 of the sealing cap 900 inserted through the aligned central shaft 843 of the sponge 840 and the aligned central shaft 819 of the dispensing nozzle 815. A respective locking tooth of each respective locking member of the sealing cap engages a respective cavity of a respective standoff of the container. The mating threads on the sealing cap thread onto the mating threads of the dispensing nozzle.

The container is substantially the same as the oval container 300 illustrated in FIGS. 1 and 2, the elliptical container 400 illustrated in FIGS. 3 and 4, and the cylindrical container illustrated in FIGS. 5 through 8. For this discussion, the container 800 is cylindrical with a sidewall 816 and a bottom wall 814. Taking from the description in FIGS. 3 through 8, but with the example being cylindrical in shape, the container 800 is fabricated to retain precautionary material, such as medicines, poison, and flammable material. It is within the spirit and scope of the present invention to include any items which may be hazardous or harmful to a child or any person if not handled properly.

The container 800 has a closed rear end 814, a sidewall 816, a transverse front end 812 with a front wall 812A supporting a central nozzle 815. The central nozzle 815 includes a small central opening 821 in distal transverse end wall 820 of nozzle 815. The opening 821 extends to an internal shaft 819 which extends through the entire length of the nozzle and is in fluid communication with container opening 802 in transverse front end 812. The container includes an interior chamber 808 surrounded by closed rear end 814, sidewall 816 and transverse front end 812. Therefore, opening 821 is in fluid communication with interior chamber 808 through internal shaft 819 and chamber opening 802. Any contents within interior chamber 802 is dispensed through nozzle opening 821 by squeezing the container sidewall 816. The nozzle and opening replaces the previous roller ball dispensing member.

Closing the cap 900 has two closing elements. First, the nozzle 815 includes external threads 817 on its sidewall 813. The threads mate with mating teeth 950 of cap 900 to facilitate the cap 900 being screwed onto the nozzle 815. In addition, the container transverse front wall 812A includes a pair of oppositely disposed standoffs 810 and 811 which engage the teeth 966 and 976 in the sealing cap 900 and function to lock the sealing cap 900 onto the container 800 for a child-proof locking arrangement as previously discussed.

The sealing cap 900 is removably affixed to the dispensing nozzle with the shaft 1020 of the central post 1000 of the sealing cap 900 inserted through the aligned openings 821, 819 and 802 so that any contents within interior chamber 808, no matter how liquid the substance, will remain in the chamber due to the sealing of the central chamber 808 by the central post 1000. The sealing is primarily leak proof after the cap 900 is double closed by the child proof locking members and the threaded engagement described above.

Referring to FIG. 20, an additional improvement is the affixation of an applicator sponge 840 having a cylindrical body 842, a transverse distal front surface 820 and a proximal rear surface 847. The applicator sponge 840 is affixed at its proximal rear surface 847 to the transverse front surface 820 of nozzle 815. The applicator sponge 840 has a central opening 846 in transverse distal front surface 844. The central opening 846 is aligned with sponge interior shaft 843 which extends through the entire length of the applicator sponge 840 and is aligned with nozzle opening 821. Therefore, aligned fluid passage openings and channels 846, 843, 821, 819 and 802 provide a path so that squeezing of the body 816 will force contents out of opening 846. For sealing. The shaft 1020 of the central post 1000 is inserted through openings 846, 843, 821, 819 and 802. The cap 900 is removably affixed to the container 800 as previously described and the central post 1000+seals the interior chamber 808 as previously described so that any contents within interior chamber 808, no-matter how liquid the substance, will remain in the chamber.

The key improvement is when the sealing cap 900 is inserted over the sponge 840 and nozzle 815, the shaft 1020 of the post 1000 is inserted through aligned openings as discussed. Therefore, the post 1000 prevents any container contents 2000 from seeping out after the container is closed with the child-proof locking assembly.

As with the other embodiments, the sidewall 816 of the container 800 is made of material selected from the group consisting of rolled laminated plastic and rolled laminated aluminum, each having from one (1) to eight (8) layers of rolled laminated plastic or aluminum. The plastic is selected from the group consisting of polypropylene, polyethylene, polyvinyl or combinations including one or more of these plastics. The rolled laminated material creates a flexible sidewall so that the contents in the container is squeezed out of the interior chamber in other container and dispensed.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An apparatus comprising:

a. a sealing cap including:

(i) a transverse top wall having an exterior surface and an interior surface, the transverse top wall is integrally formed with an exterior circumferential sidewall having an exterior surface and an interior surface, (ii) the interior surface of the transverse top wall is also integrally formed with an interior circumferential sidewall having an exterior surface and an interior surface, (iii) the exterior circumferential sidewall having a first height, the interior circumferential sidewall having a second height with the first height taller than the second height, (iv) the interior circumferential sidewall includes cap mating teeth on the interior surface, spacer members located between the interior surface of exterior circumferential sidewall and the exterior surface of the of interior circumferential sidewall, (v) the interior surface of the exterior circumferential sidewall includes a first locking member including a first transverse bar extending from the interior surface of the exterior sidewall toward a center of the sealing cap and a first locking tooth at a distal end of the first transverse bar, (vi) the interior surface of the exterior circumferential sidewall includes a second locking member including a second transverse bar extending from the interior surface of the exterior sidewall toward a center of the sealing cap and a second locking tooth at a distal end of the second transverse bar, (vii) the first locking member is parallel to and opposite to the second locking member, (viii) a first marker on the exterior surface of the exterior circumferential sidewall aligned with the first locking member and a second marker on an oppositely disposed location of the exterior surface of the exterior circumferential sidewall aligned with the second locking member, (ix) a central longitudinal post having a proximal end integrally formed at a center of the interior surface of the top transverse wall which corresponds with the center of the sealing cap, the central longitudinal post includes an elongated shaft terminating at a distal end, a body of the central longitudinal post is cylindrical except the portion of the body at a distance from the distal end tapers from cylindrical to a rounded pointed distal end;

b. a container including:

(i) an integrally formed exterior flexible longitudinal sidewall, a closed rear end, and a transverse front wall having a centrally located dispensing nozzle including a longitudinal interior shaft extending from an opening at a distal transverse wall of the nozzle to and through the transverse top wall to an interior chamber surrounded by the closed rear end, the exterior flexible longitudinal sidewall, and the transverse front wall, (ii) the dispensing nozzle having a longitudinal sidewall including mating threads which mate with the threads on the sealing cap, (iii) the container further includes a sponge having a transverse proximal rear surface, a cylindrical body and a transverse distal front surface, the transverse proximal rear surface of the sponge affixed to the transverse front wall of the dispensing nozzle, the sponge including an interior shaft extending from the distal front surface to the proximal rear surface and aligned with the longitudinal interior shaft of the dispensing nozzle, (iv) the transverse front wall of the container further including a first standoff affixed to the front wall of the container and located between the dispensing nozzle and a top circumferential edge of the front wall, the first standoff having a first body with a first cavity extending from a surface of the first body into the first body, an oppositely disposed second standoff affixed to the front wall of the container and located between the dispensing nozzle and a top circumferential edge of the front wall, the second standoff having a second body with a second cavity extending from a surface of the second body into the second body, the first standoff and the second standoff parallel to each other and located on opposite sides of the dispensing nozzle;

c. the sealing cap removably affixed to the dispensing nozzle with the central post of the sealing cap inserted through the aligned central shaft of the sponge and the aligned central shaft of the dispensing nozzle, a respective locking tooth of each respective locking member of the sealing cap engaging a respective cavity of a respective standoff of the container, and the mating threads of the sealing cap threaded onto the mating threads of the dispensing nozzle; and d. said exterior flexible longitudinal sidewall of the container made of material selected from the group consisting of rolled laminated plastic having from one (1) to eight (8) layers of rolled laminated plastic and rolled laminated aluminum having from one (1) to eight (8) layers of rolled laminated aluminum;

e. whereby, a simultaneous inward pressure on said exterior surface of said exterior circumferential sidewall of the sealing cap at the locations of said first marker and second marker and rotation of said sealing cap enables said first tooth to engage said first cavity and said second tooth to engage said second cavity to lock said cap onto a front of said container, and removing said cap from said container requires finding the locations of said first marker and said second marker to cause a simultaneous inward force on said first marker at said exterior surface of said exterior longitudinal sidewall and on said second marker at said exterior surface of said exterior longitudinal sidewall and reverse-rotation of said sealing cap to disengage said first tooth from said first cavity and said second tooth from said second cavity, and the insertion of the central post into the aligned shafts of the sponge and dispensing nozzle reduces a possibility of contents within the interior chamber of the container from seeping out of the aligned interior shafts of the dispensing nozzle and sponge.

2. The apparatus in accordance with claim 1, further comprising: said exterior flexible longitudinal sidewall of said container is formed in a shape selected from the group consisting of oval-shaped, elliptical-shaped and cylindrical-shaped.

3. The apparatus in accordance with claim 1, further comprising: said rolled laminated plastic is selected from the group consisting of polypropylene, polyethylene, polyvinyl, and combinations including one or more of said polypropylene, polyethylene, polyvinyl.

4. An apparatus comprising:

a. a sealing cap including:

(i) a transverse top wall having an exterior surface and an interior surface, the transverse top wall is integrally formed with an exterior circumferential sidewall having an exterior surface and an interior surface, (ii) the interior surface of the transverse top wall is also integrally formed with an interior circumferential sidewall including an interior surface having cap mating teeth on the interior surface, (iii) the interior surface of the exterior circumferential sidewall includes a first locking member including a first transverse bar extending from the interior surface of the exterior sidewall toward a center of the sealing cap and a first locking tooth at a distal end of the first transverse bar, (iv) the interior surface of the exterior circumferential sidewall includes a second locking member including a second transverse bar extending from the interior surface of the exterior sidewall toward a center of the sealing cap and a second locking tooth at a distal end of the second transverse bar, (v) the first locking member is parallel to and opposite to the second locking member, (vi) a first marker on the exterior surface of the exterior circumferential sidewall aligned with the first locking member and a second marker on an oppositely disposed location of the exterior surface of the exterior circumferential sidewall aligned with the second locking member, (vii) a central longitudinal post having a proximal end integrally formed at a center of the interior surface of the top transverse wall which corresponds with the center of the sealing cap, the central longitudinal post includes an elongated shaft terminating at a distal end;

b. a container including:

(i) an integrally formed exterior flexible longitudinal sidewall, a closed rear end, and a transverse front wall having a centrally located dispensing nozzle including a longitudinal interior shaft extending from an opening at a distal transverse wall of the nozzle to and through the transverse top wall to an interior chamber surrounded by the closed rear end, the exterior flexible longitudinal sidewall, and the transverse front wall, (ii) the dispensing nozzle having a longitudinal sidewall including mating threads which mate with the threads on the sealing cap, (iii) the transverse front wall of the container further including a first standoff affixed to the front wall of the container and located between the dispensing nozzle and a top circumferential edge of the front wall, the first standoff having a first body with a first cavity extending from a surface of the first body into the first body, an oppositely disposed second standoff affixed to the front wall of the container and located between the dispensing nozzle and a top circumferential edge of the front wall, the second standoff having a second body with a second cavity extending from a surface of the second body into the second body, the first standoff and the second standoff parallel to each other and located on opposite sides of the dispensing nozzle;

c. the sealing cap removably affixed to the dispensing nozzle with the central post of the sealing cap inserted through the central shaft of the dispensing nozzle, a respective locking tooth of each respective locking member of the sealing cap engaging a respective cavity of a respective standoff of the container, and the mating threads of the sealing cap threaded onto the mating threads of the dispensing nozzle; and d. said exterior flexible longitudinal sidewall of the container made of material selected from the group consisting of rolled laminated plastic having from one (1) to eight (8) layers of rolled laminated plastic and rolled laminated aluminum having from one (1) to eight (8) layers of rolled laminated aluminum;

e. whereby, a simultaneous inward pressure on said exterior surface of said exterior circumferential sidewall of the sealing cap at the locations of said first marker and second marker and rotation of said sealing cap enables said first tooth to engage said first cavity and said second tooth to engage said second cavity to lock said cap onto a front of said container, and removing said cap from said container requires finding the locations of said first marker and said second marker to cause a simultaneous inward force on said first marker at said exterior surface of said exterior longitudinal sidewall and on said second marker at said exterior surface of said exterior longitudinal sidewall and reverse-rotation of said sealing cap to disengage said first tooth from said first cavity and said second tooth from said second cavity, and the insertion of the central post into the shaft of the dispensing nozzle reduces a possibility of contents within the interior chamber of the container from seeping out of the interior shaft of the dispensing nozzle.

5. The apparatus in accordance with claim 4, further comprising: a body of the central longitudinal post is cylindrical except the portion of the body at a distance from the distal end tapers from cylindrical to a rounded pointed distal end.

6. The apparatus in accordance with claim 4, further comprising:

a. the container further includes a sponge having a transverse proximal rear surface, a cylindrical body and a transverse distal front surface, the transverse proximal rear surface of the sponge affixed to the transverse front wall of the dispensing nozzle, the sponge including an interior shaft extending from the distal front surface to the proximal rear surface and aligned with the longitudinal interior shaft of the dispensing nozzle; and b. the central post of the sealing cap also inserted through the aligned central shaft of the sponge in addition to the aligned central shaft of the dispensing nozzle.

7. The apparatus in accordance with claim 4, further comprising: said exterior flexible longitudinal sidewall of said container is formed in a shape selected from the group consisting of oval-shaped, elliptical-shaped and cylindrical-shaped.

8. The apparatus in accordance with claim 4, further comprising: said rolled laminated plastic is selected from the group consisting of polypropylene, polyethylene, polyvinyl, and combinations including one or more of said polypropylene, polyethylene, polyvinyl.

9. An apparatus comprising:

a. a sealing cap including:

(i) a transverse top wall having an exterior surface and an interior surface, the transverse top wall is integrally formed with an exterior circumferential sidewall having an exterior surface and an interior surface, (ii) the interior surface of the transverse top wall is also integrally formed with an interior circumferential sidewall including an interior surface having cap mating teeth on the interior surface, (iii) the interior surface of the exterior circumferential sidewall includes a first locking member and a second locking member, the first locking member is parallel to and opposite to the second locking member;

(iv) a central longitudinal post having a proximal end integrally formed at a center of the interior surface of the top transverse wall which corresponds with the center of the sealing cap, the central longitudinal post includes an elongated shaft terminating at a distal end;

b. a container including:

(i) an integrally formed exterior flexible longitudinal sidewall, a closed rear end, and a transverse front wall having a centrally located dispensing nozzle including a longitudinal interior shaft extending from an opening at a distal transverse wall of the nozzle to and through the transverse top wall to an interior chamber surrounded by the closed rear end, the exterior flexible longitudinal sidewall, and the transverse front wall, (ii) the dispensing nozzle having a longitudinal sidewall including mating threads which mate with the threads on the sealing cap;

(iii) the transverse front wall of the container further including a first standoff affixed to the front wall of the container and located between the dispensing nozzle and a top circumferential edge of the front wall, and an oppositely disposed second standoff affixed to the front wall of the container and located between the dispensing nozzle and a top circumferential edge of the front wall;

c. the sealing cap removably affixed to the dispensing nozzle with the central post of the sealing cap inserted through the central shaft of the dispensing nozzle, a respective locking member engaging a respective standoff of the container, and the mating threads of the sealing cap threaded onto the mating threads of the dispensing nozzle; and d. said exterior flexible longitudinal sidewall of the container made of material selected from the group consisting of rolled laminated plastic having from one (1) to eight (8) layers of rolled laminated plastic and rolled laminated aluminum having from one (1) to eight (8) layers of rolled laminated aluminum;

e. whereby, a simultaneous inward pressure on said exterior surface of said exterior circumferential sidewall of the sealing cap and rotation of said sealing cap enables engagement of said first locking member with said first standoff and engagement of said second locking member with said standoff to lock said cap onto a front of said container, and removing said cap from said container requires a simultaneous inward force on said exterior longitudinal sidewall and reverse-rotation of said sealing cap to disengage said first locking member from said first stand-off and said second locking member from said second standoff, and the insertion of the central post into the shaft of the dispensing nozzle reduces a possibility of contents within the interior chamber of the container from seeping out of the interior shaft of the dispensing nozzle.

10. The apparatus in accordance with claim 9, further comprising: a body of the central longitudinal post is cylindrical except the portion of the body at a distance from the distal end tapers from cylindrical to a rounded pointed distal end.

11. The apparatus in accordance with claim 9, further comprising:

a. the container further includes a sponge having a transverse proximal rear surface, a cylindrical body and a transverse distal front surface, the transverse proximal rear surface of the sponge affixed to the transverse front wall of the dispensing nozzle, the sponge including an interior shaft extending from the distal front surface to the proximal rear surface and aligned with the longitudinal interior shaft of the dispensing nozzle; and b. the central post of the sealing cap also inserted through the aligned central shaft of the sponge in addition to the aligned central shaft of the dispensing nozzle.

12. The apparatus in accordance with claim 9, further comprising: said exterior flexible longitudinal sidewall of said container is formed in a shape selected from the group consisting of oval-shaped, elliptical-shaped and cylindrical-shaped.

13. The apparatus in accordance with claim 9, further comprising: said rolled laminated plastic is selected from the group consisting of polypropylene, polyethylene, polyvinyl, and combinations including one or more of said polypropylene, polyethylene, polyvinyl.

* * * * *